US005141351A

United States Patent [19]

Imai

[11] Patent Number: 5,141,351

[45] Date of Patent: Aug. 25, 1992

[54] JOINT DEVICE OF TRUSS STRUCTURE MEMBER

[75] Inventor: Katsuhiko Imai, Hyogo, Japan

[73] Assignee: Kawatetsu Kenzaikogyo Kabushiki Kaisha, Hyogo, Japan

[21] Appl. No.: 601,782

[22] PCT Filed: Mar. 26, 1990

[86] PCT No.: PCT/JP90/00395

§ 371 Date: Oct. 30, 1990

§ 102(e) Date: Oct. 30, 1990

[87] PCT Pub. No.: WO90/11416

PCT Pub. Date: Oct. 4, 1990

[30] Foreign Application Priority Data

Mar. 27, 1989 [JP] Japan ..... 1-35392

[51] Int. Cl.[5] ..... F16D 1/00

[52] U.S. Cl. ..... 403/171; 403/176

[58] Field of Search ..... 403/171, 176, 170, 172

[56] References Cited

U.S. PATENT DOCUMENTS 4,313,687 2/1982 Apeztegui et al. ..... 403/171

4,789,264 12/1988 Inchaurbe ..... 403/171 X 4,872,779 10/1989 Imai ..... 403/171

4,915,533 4/1990 de la Haye ..... 403/171

*Primary Examiner*—Andrew V. Kundrat

*Attorney, Agent, or Firm*—Lowe, Price, LeBlanc & Becker

[57] ABSTRACT

A device for joining an elongate structural member having a hollow end to a connector node includes a cover for the hollow end and an elongate bolt extending a threaded end therethrough for engaging with the node. A portion of the bolt between the threaded distal end and a bolt head at the opposite end has the form of a square cross-sectioned boss which has an external thread cut into corner portions thereof such that the square boss can be threaded through an internally threaded aperture in the cover, this internally threaded aperture being smaller than the bolt head. A sleeve having a length longer than the square boss has a square through-aperture sized to slidingly fit around the square boss. During use of the device, the cover is welded to an end of the elongate structural member, the sleeve is slidingly fitted around the square boss and a threaded distal end of the bolt is threaded to a matchingly sized threaded aperture in a node and the bolt is tightened thereto by the application of an external torque provided to an outside surface of the sleeve.

4 Claims, 11 Drawing Sheets

JOINT DEVICE OF TRUSS STRUCTURE MEMBER

TECHNICAL FIELD OF THE INVENTION

The present invention relates to a joint device for truss structure members and, more particularly, to a device capable of easily and tightly joining a plurality of long structure members to nodes in a space truss structure.

BACKGROUND OF THE PRIOR ART

In constructing a space truss structure, using a multiplicity of structure members, e.g. lengths of steel pipe, each end of the structure members is joined to the spherical node. In order to radially join the structure members to nodes provided with several fastening portions, joint devices equipped with fastening bolts are commonly used. In that case, however, it may frequently be impossible to firmly screw the fastening bolt into a screw hole of the node.

Upon assembling all but one of the portions of the truss, the positions of the two nodes between which the final structure member is to be joined are established. Under this circumstance, if the end of the fastening bolt projects too far from the joint device, the last structure member cannot be fitted into the space between the two nodes whose separation has been already defined by assembly of the other members.

In order to solve the afore-mentioned problems, the applicant proposed in U.S. Pat. No. 4,872,779 a joint device wherein the fastening bolt can be led back into the side of the structure member. Such a joint device 41 is equipped with a spring 29 generating an elastic force, as best seen in FIG. 11 hereof. When the end of a threaded part 26*a* of the fastening bolt 6 comes into contact with the node (not shown), the spring 29 is automatically compressed. As shown by the two-dot chain line in FIG. 11, the threaded part 26*a* is then retracted into a sleeve 21. For this reason, the structure member 31 which is exactly sized to match with a designed length and the joint device 41 can be easily fitted into the space between the two nodes whose separation has been already defined.

In the joint device 41 described above, the spring 29 urges the fastening bolt 6 into a screw hole of the node. When the structure member 31 is directed to be in a vertical state as shown in FIG. 11, only the relatively weak elastic force of the spring 29 cannot lift the fastening bolt 6 up to the node enough to commence to be engaged with the screw hole of the node. For this reason, even a rotation of the sleeve 21 will not be able to facilitate an advance of the threaded part 26*a* toward the screw hole of the node. This is because initial engagement between the fastening bolt 6 and the screw hole of the node cannot be accurately assured.

SUMMARY OF THE DISCLOSURE

The objects of the present invention are:

(a) to enable the last structure member to be easily fitted between the last two nodes, even when a completion of assembly of almost all the other parts of the truss has caused the length between the last two nodes, to which the last structure member is to be interposingly connected, to be already defined;

(b) to enable a connection between the structure member and the nodes to which it is to be connected to be quickly performed, and a removal of the structure member from the nodes to be easily executed;

(c) to provide a joint device of as simplified a structure as possible;

(d) to enable the structure member to be firmly connected to the node;

(e) to provide a joint device of superior durability, wherein the fastening bolt therein does not have direct exposure to atmosphere, thereby restraining corrosion of the fastening bolt; and (f) to enable an initial advance of the fastening bolt, made by the rotation of the sleeve, to be facilitated by a means other than engagement between a threaded part of the fastening bolt and a screw hole of the node, whereby the structure member can be smoothly connected to the node even when the fastening bolt is directed to be in a vertical state with respect to the node.

The present invention in its preferred embodiment relates to a joint device equipped with a fastening bolt for connecting an elongate structure member to a node. It includes a sleeve, covering the fastening bolt for transmitting a rotational motion to the fastening bolt and also for sliding the fastening bolt to the node.

The fastening bolt includes a threaded part formed to engaged with a screw hole of a node, a square boss formed on the middle part of the fastening bolt and having a diameter larger than that of the threaded part, a body portion formed between the square boss and a bolt head with a diameter smaller than that of the square boss, and an outside thread formed along each of angular tops of the square boss having a thread pitch identical to that of the threaded part.

An edge cover located at the end of the structure member has a hole whose diameter is smaller than that of the bolt head and includes a supporting part whose length is shorter than that of the body portion, and a female thread formed around the hole of the supporting part and sized to be engaged with the outside thread of the square boss.

The sleeve is formed to be longer than the square boss and includes a square hole sized to receive the square boss such that the square boss may be axially slidable therein. The sleeve has an external torque transmitting surface.

The total length of the square boss and the body portion taken together is shorter than the length of the sleeve added to the length of the supporting part.

As a result, even when the assembly of almost all other parts of the truss has already defined the length of the space between the two nodes to which the last structure member is to be interposingly connected, it is possible to easily fit the structure member and the joint device between the two nodes. Furthermore, during the work of having the fastening bolt rotated to mount or remove the structure member to/from the node, no damage occurs to the joint device, and the application of an excessive force upon the structure member and the joint device is avoided.

After incorporation of the structure members among the nodes, a stressed state of the structure can be realized as designed. The resulting joint device does not produce a direct contact between the fastening bolt and the atmosphere and hence restrains corrosion thereof, thus providing high reliability. Furthermore, a reduction in the actual number of parts constituting the joint device minimizes the size thereof.

DESCRIPTION OF THE PREFERRED EMBODIMENTS

Figure 1:
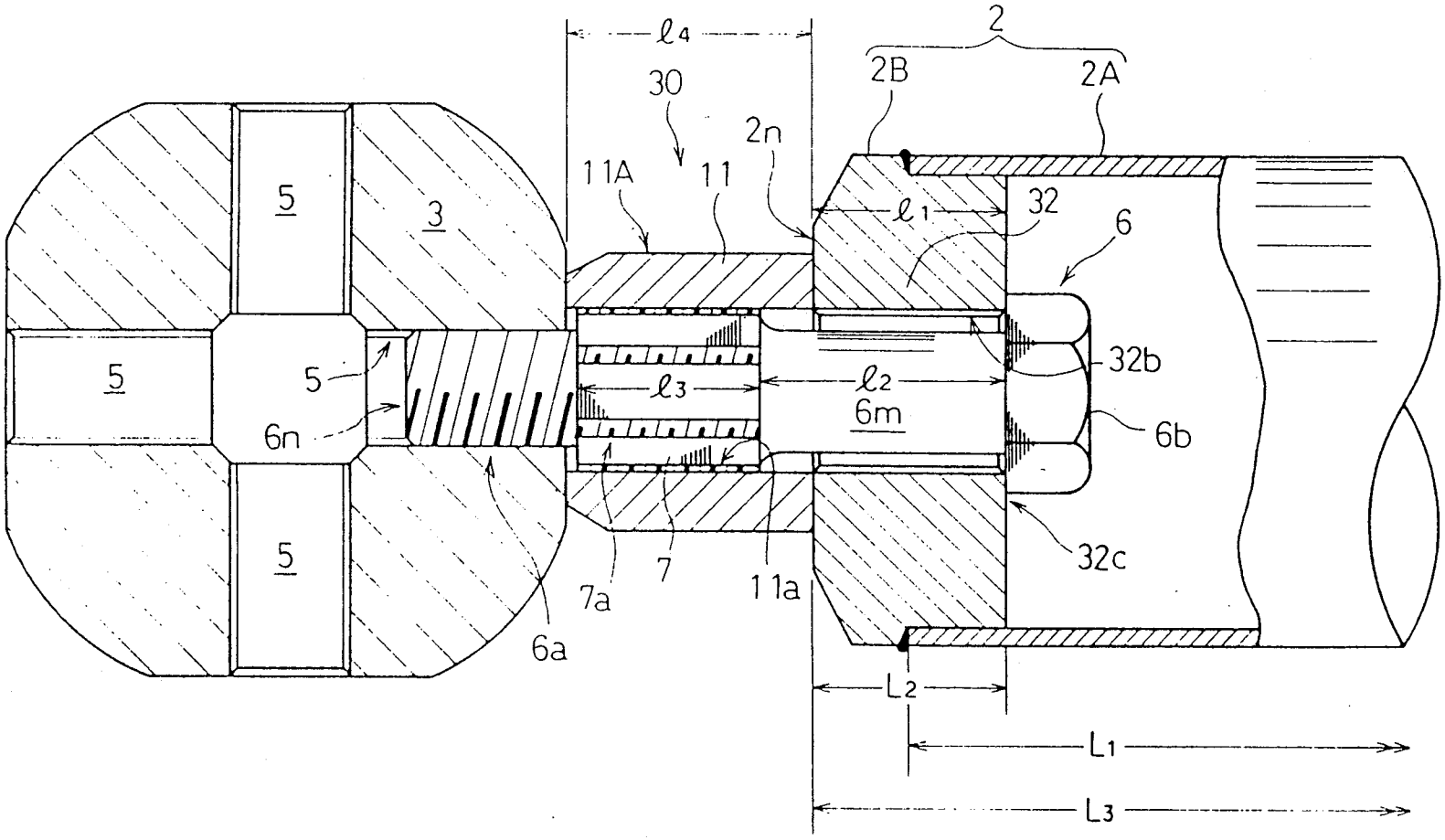
FIG. 1 is a sectional view of the structure member to which the joint device of the present invention is applied.

FIG. 1 is a sectional view of an entire joint device 30 engaged to a node. The structure member 2 is radially connected to the node 3 by the fastening bolt 6.

A threaded part 6*a* is formed on one end of the fastening bolt 6 for engagement with a screw hole of the node 3. Square boss 7 has a lateral size larger than that of the threaded part 6*a*, and is provided around the middle part of the fastening bolt 6. A body portion 6*m*, whose diameter is smaller than that of the square boss 7, is formed between the square boss 7 and the bolt head 6*b*. Since it is not necessary to rotate the fastening bolt 6 itself by a bolt head 6*b* during use, such the round type shown in FIG. 10, may also be acceptable as the bolt head 6*b*.

An outside thread 7*a* is formed along each of angular tops of the square boss 7. The square boss 7 is slidingly contained in contact with an inner surface in the sleeve 11, and is not free to be independently rotated on the sleeve 11. A female thread 32*b* is formed along the inner face of the supporting part 32 of the edge cover 2B. The diameter of the female thread 32*b* is smaller than that of the bolt head 6*b*.

Figure 5:
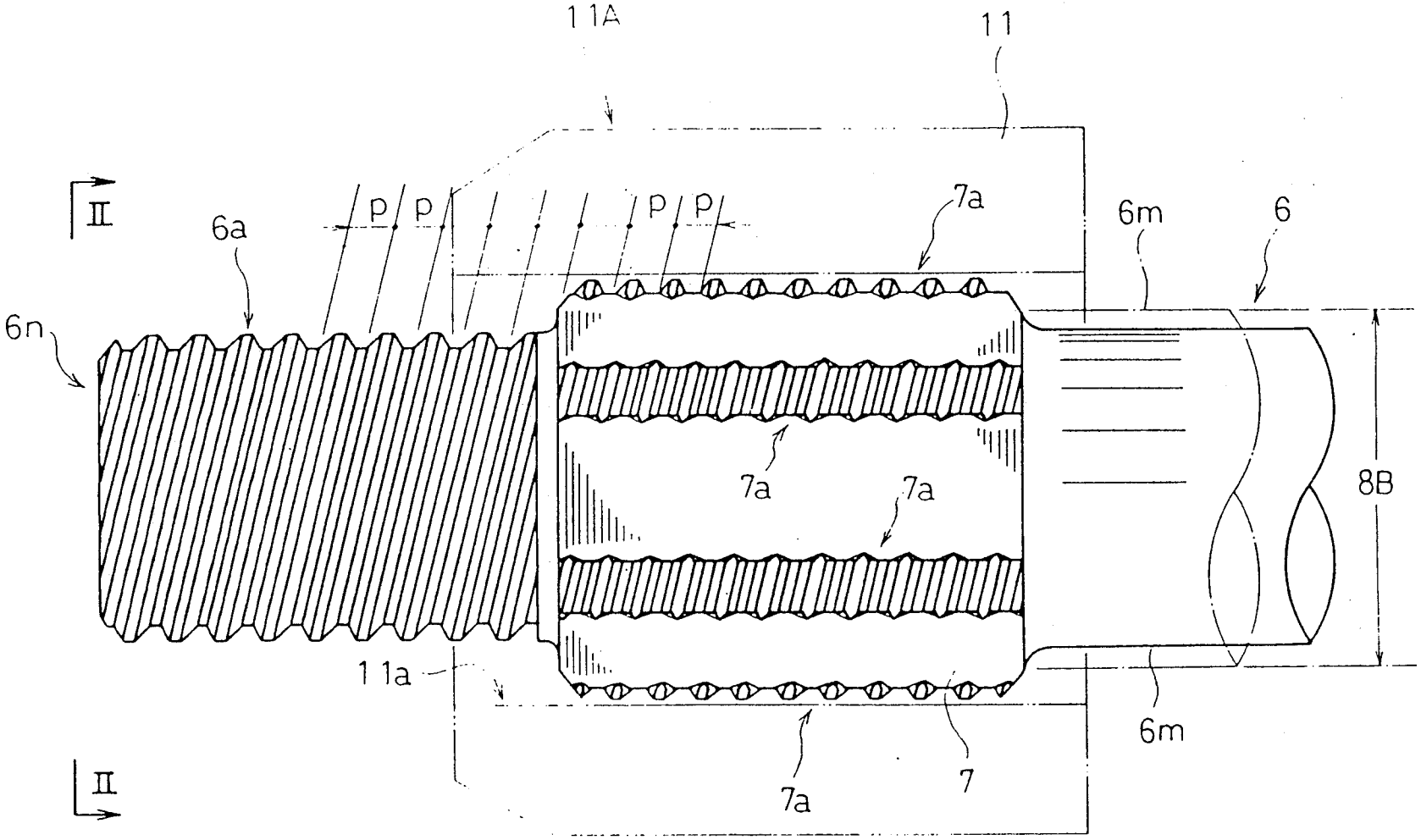
FIG. 5 is a longitudinal side view of the threaded part and the square boss of the fastening bolt.
Figure 6:
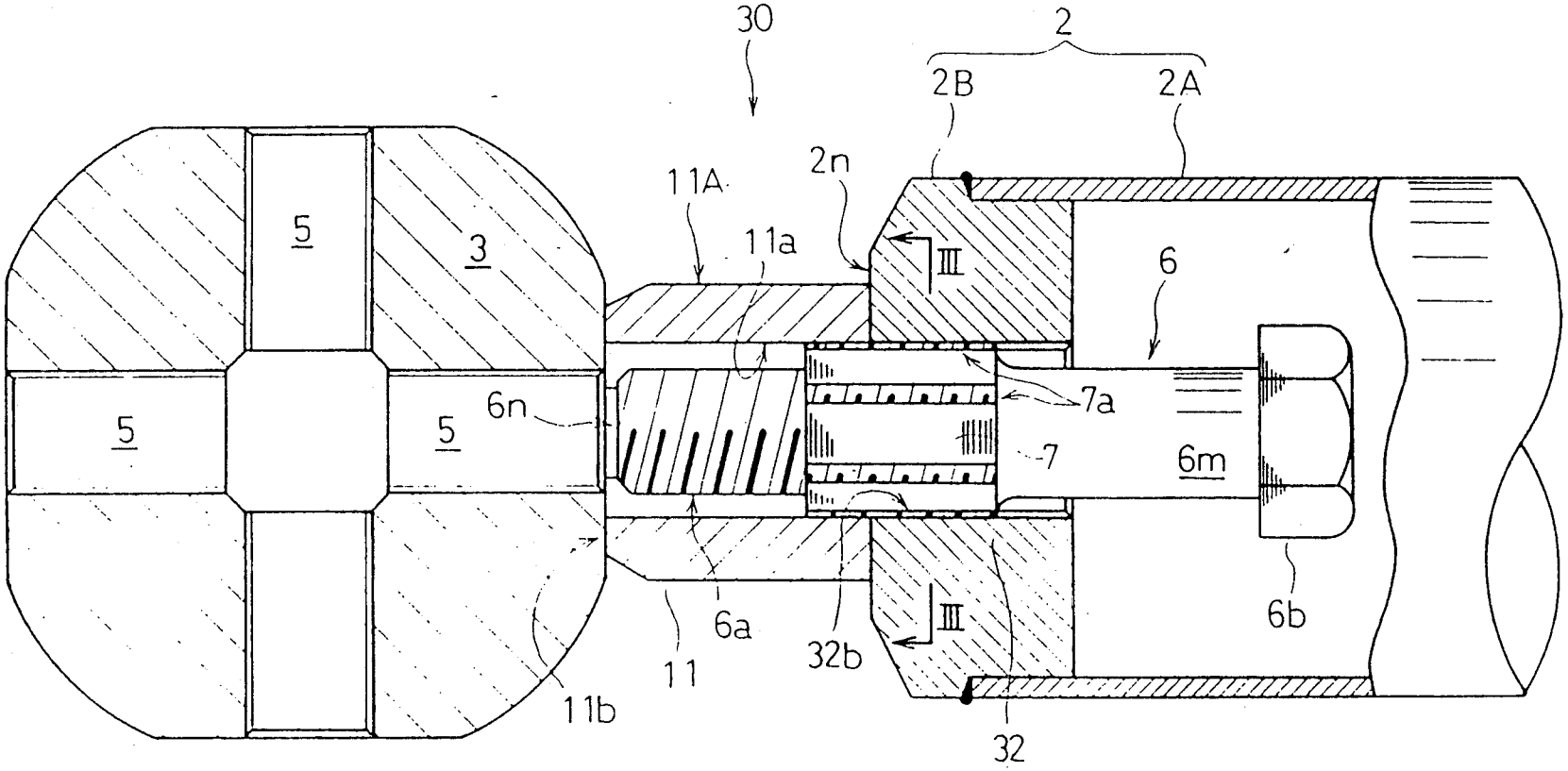
FIG. 6 is a sectional view in a state where the end of the threaded part of the fastening bolt is located in the sleeve.

The outside thread 7*a* of the square boss 7 can be engaged with the female thread 32*b*. As shown in FIG. 5, the pitch "p" of the outside thread 7*a* is the same as the pitch "p" of the threaded part 6*a*, and the spiral directions of both threads are also identical to each other. For this reason, as shown in FIG. 6, when the square boss 7 is advancing in the supporting part 32, the threaded part 6*a* is advancing in the screw hole 5 of the node 3 as well.

Figure 2:
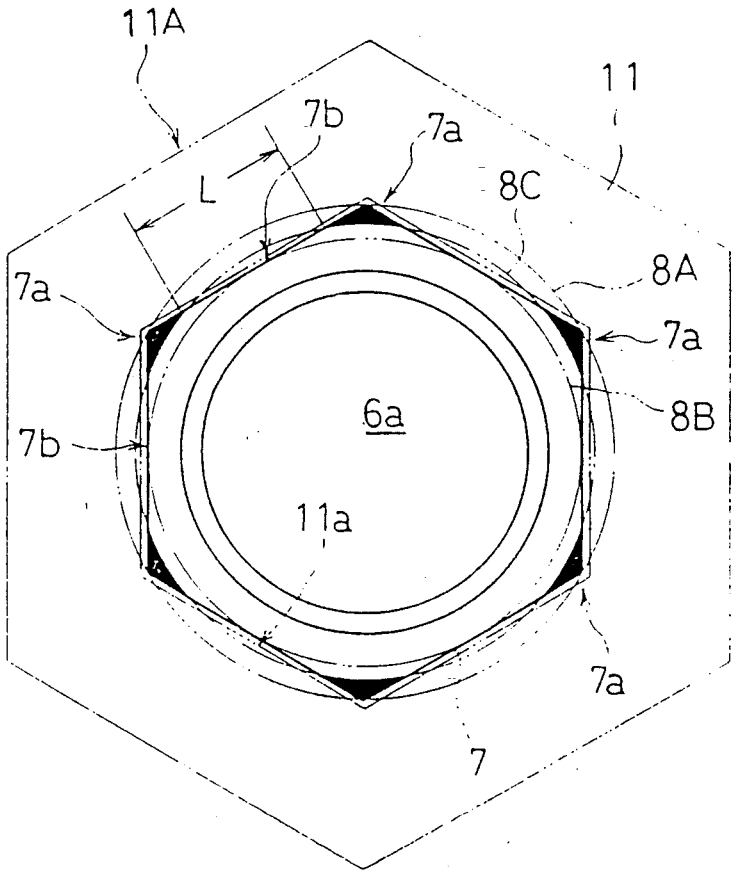
FIG. 2 is a view taken along line II—II of FIG. 5.

As shown in FIG. 2, the outer diameter of outside thread 7*a* is equal to the diameter of a circumscribed circle 8A of the square boss 7 of regular hexagon. On the other hand, the bottom diameter of the outside thread 7*a* is equal to the diameter of an intermediate circle 8C located between the circumscribed circle 8A and an inscribed circle 8B. The outside thread 7*a* is located at each of dark shadings in the illustration of FIG. 2. A flat part 7*b*, of a length "L", is secured between the two outside threads 7*a*, 7*a* on the angular corners of the square boss 7.

Figure 4:
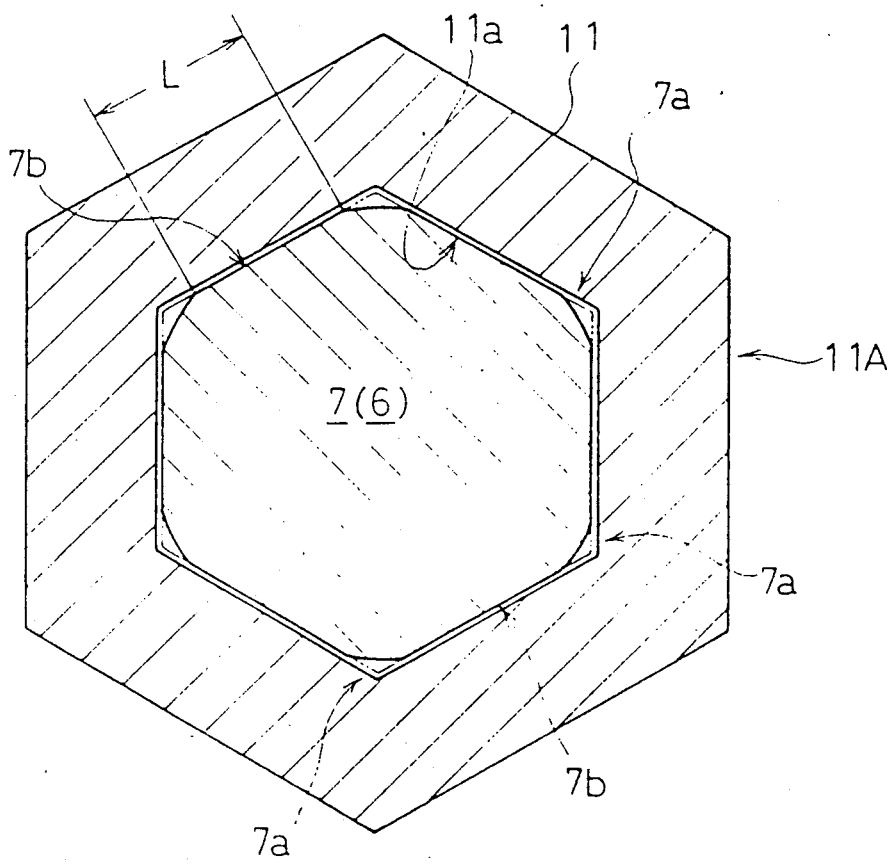
FIG. 4 is a view taken along line IV—IV of FIG. 7.
Figure 7:
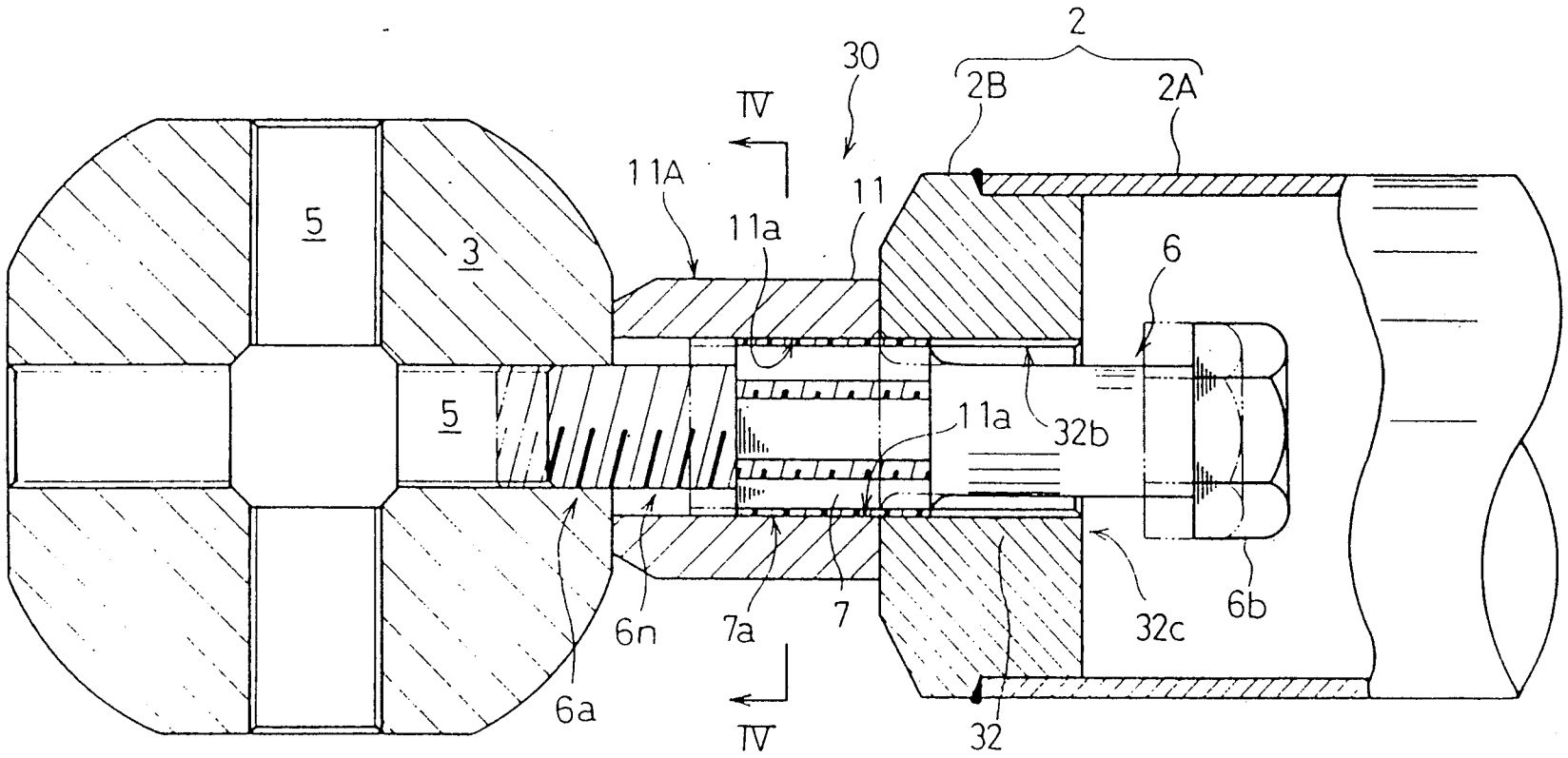
FIG. 7 is a sectional view in a state where the fastening bolt is making an advance into the node.

The flat part 7*b* is in sliding contact with each of faces of a square hole 11*a* of such a sleeve 11 as shown in FIG. 4. A rotation of the sleeve 11 will therefore cause the square boss 7 to be correspondingly rotated and, as shown in FIG. 7, it becomes possible for the threaded part 6*a* to be engaged with the screw hole 5 under a state where the square boss 7 is engaged with the female thread 32*b*.

Figure 10:
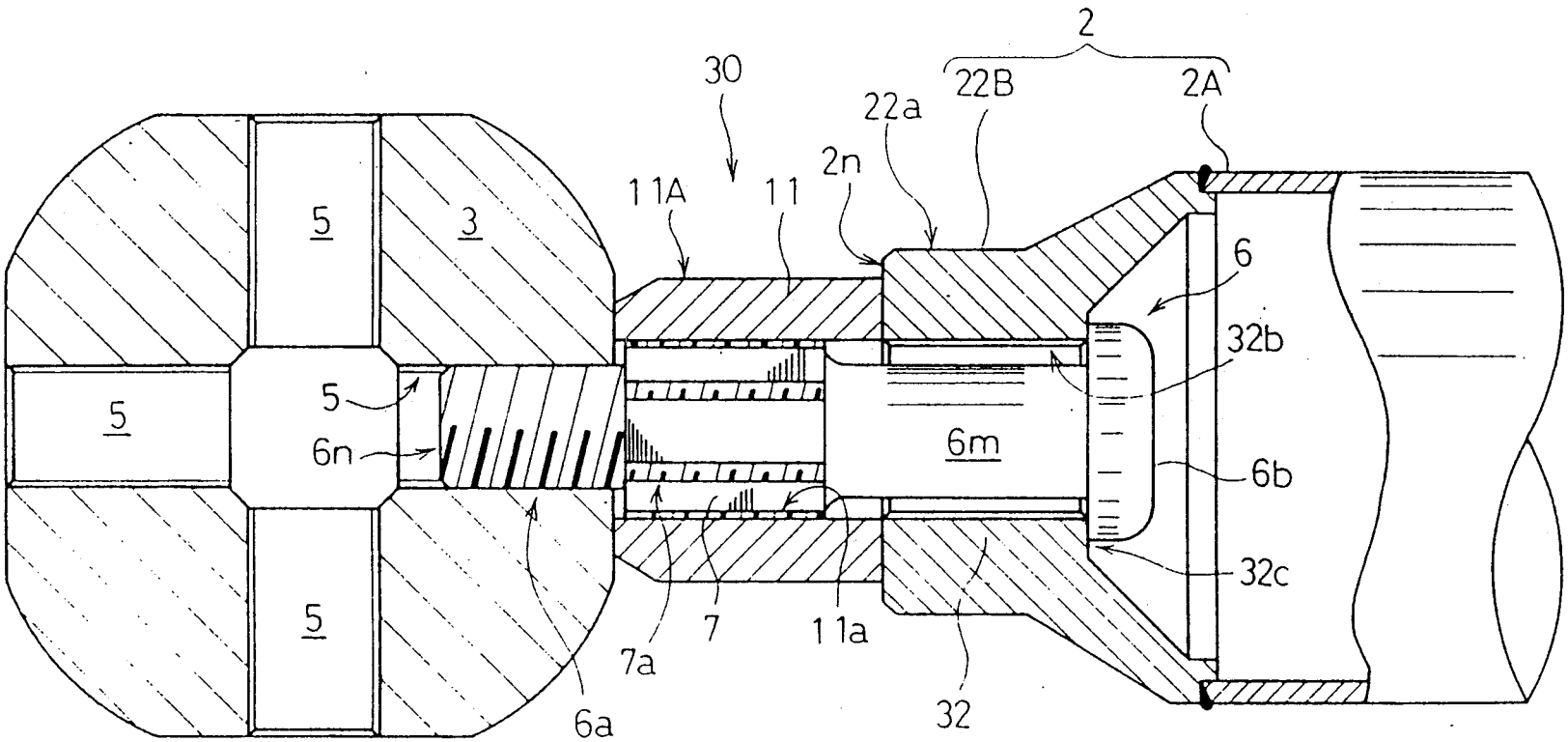
FIG. 10 is a structural view of another embodiment of structure member that is equipped with an approximately truncated-cylindrical edge cover and a fastening bolt having a round bolt head.

Referring again to FIG. 1, the structure member 2 comprises a main body member 2A, preferably made of an elongated steel pipe, and an edge cover 2B closing an end face at a hollow end of the main body member. Before welding the thick edge cover 2B to the end face of the main body member 2A, the fastening bolt 6 is mounted to the edge cover 2B. In that case, such a truncated edge cover 22B as shown in FIG. 10 may be acceptable in place of the edge cover 2B. The outer surface of the edge cover 22B may be formed to be hexagonal in cross-sectional view (see FIG. 2), and this enables application of a rotational torque for rotating the sleeve 11. It thus becomes extremely easy to apply the specified rotational torque to the sleeve 11.

The length "$l_1$" of such a supporting part 32 as shown in FIG. 1 is less than the length "$l_2$" of the body portion 6*m*. The diameter of the female thread 32*b* formed on the inner face of the supporting part 32 is large enough to be penetrated by the body portion 6*m* in an insertional manner. Therefore, the diameter of the body portion 6*m* is less than the diameter of the inscribed circle 8B of FIG. 2. (The maximum diameter of the body portion 6*m* is shown by one-dot chain line in FIG. 5.)

In reference to FIG. 1, it is apparent that the sleeve 11 for transmitting rotational torque to the fastening bolt 6 is adapted to be in contact with the outer face of the square boss 7. The sleeve 11 is equipped with a square hole 11*a* which enables the square boss 7 to be axially slided therein. The length "$l_4$" of the sleeve 11 is longer than the length "$l_3$" of the square boss 7. Under a state where the fastening bolt 6 is deeply engaged with the node 3, it is necessary that the bolt head 6*b* contacts with the end face 32*c* of the supporting part 32. The total length "$(l_2+l_3)$", obtained by adding the length of the body portion 6*m* and the length of the square boss 7 to each other, is shorter than the total length, "$(l_1+l_4)$", obtained by adding the length of the supporting part 32 and the length of the sleeve 11 to each other.

The outer face of the sleeve 11, as previously described, preferably has torque transmitting surfaces 11A for rotating the square boss 7. Both the square boss 7 and the sleeve 11 are preferably of hexagonal section. The section of the sleeve 11 is made such that it can be rotated by a conventional tool such as a wrench.

A description of the steps for connecting the structure member 2 to the node 3 follows.

Figure 8:
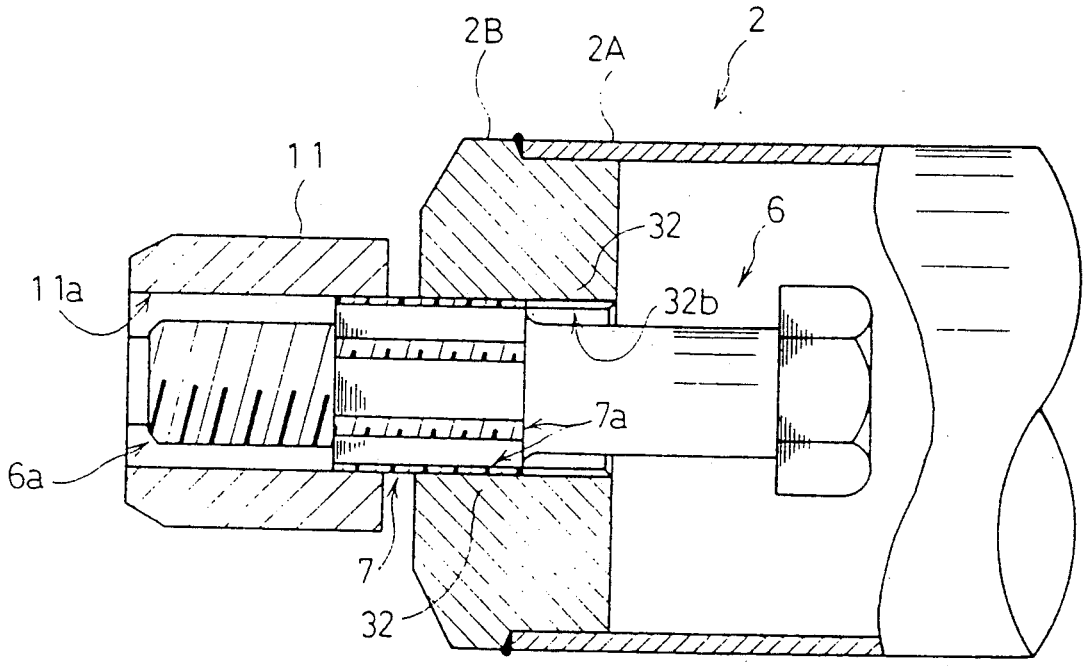
FIG. 8 is view in a state before the structure member is connected to the node.

As shown in FIG. 8, the fastening bolt 6 is inserted into the supporting part 32 of the edge cover 2B of the specified length. The outside thread 7*a* is then engaged with the female thread 32*b*. After that, the edge cover 2B is welded to the end of the main body member 2A which is formed of a selected length.

The length "$l_3$" of the structure member 2, including the edge covers 2B located at both ends thereof, as shown in FIG. 1 must be accurate. Suitable machining accurately determines the length "$l_1$" of the main body member 2A and the length "$l_2$" of the edge cover 2B. When welding the edge covers 2B to both ends respectively of the main body member 2A, the length "$l_3$" between one end face 2*n* of one edge cover 2B and another end face of the opposite edge cover can be accurately defined by a method such as the invention proposed in Unexamined Japan Patent Publication No. 1-121429. Since the pertaining welding method has no direct relation with the present invention, a description thereof is omitted.

The sleeve 11 is put on the square boss 7 as shown in FIG. 8 and comes into contact with the end face 2*n* of the edge cover 2B. Reverse rotation of the sleeve 11 will permit the end 6*n* of the fastening bolt 6 to come into an area inward of the end face 11*b* of the sleeve 11. Subsequently, the fastening bolt 6 is led back into the side of the structure member 2 so that the joint device 30 and the structure member 2 may be carried to be interposed between two nodes.

Figure 9:
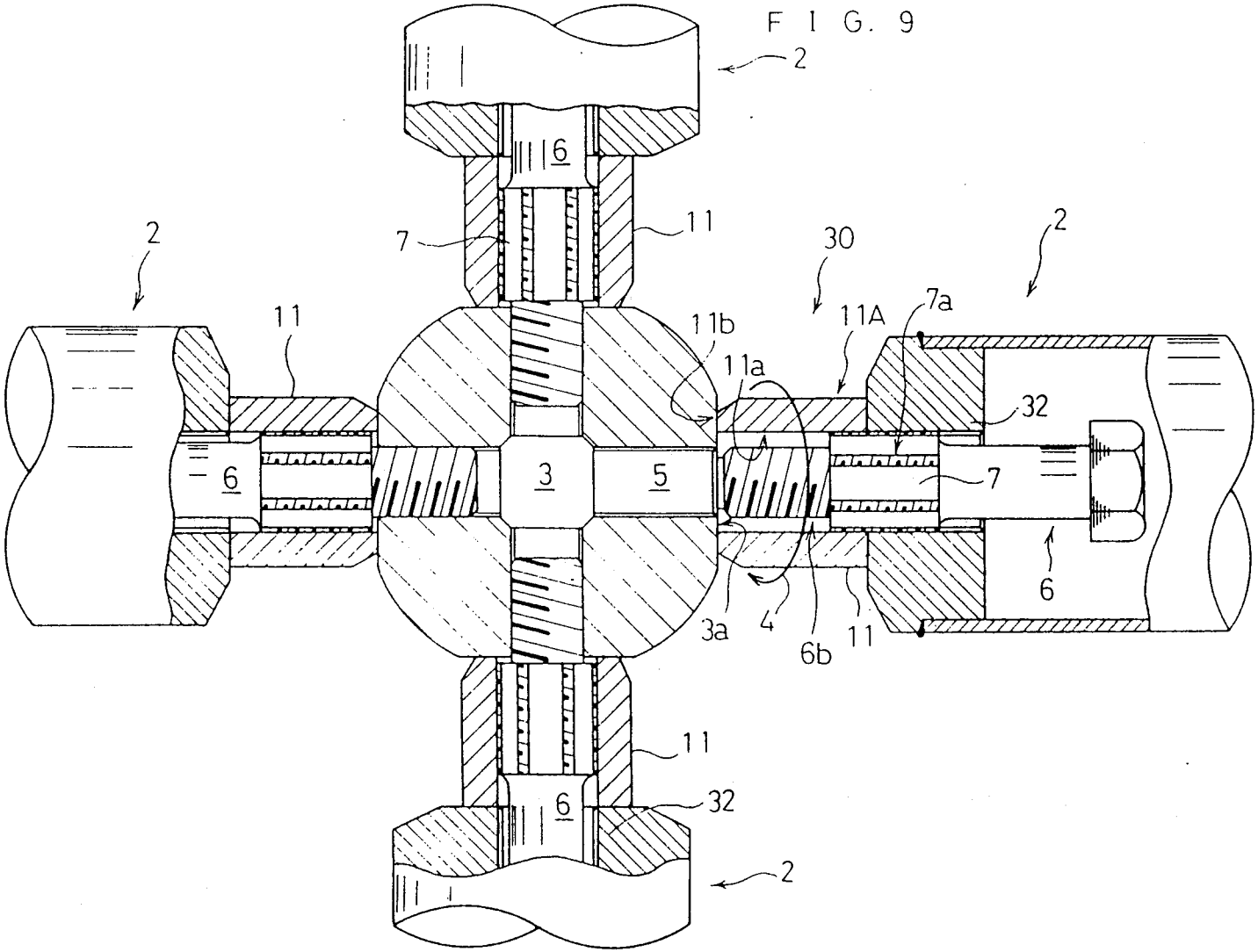
FIG. 9 is a sectional view illustrating the connection operation.

As shown in FIG. 9, end face 11*b* of the sleeve 11 comes into contact with the flat face 3*a* of the node 3. The structure member 2 has an exact length "$l_3$". Even when assembling of almost all the parts of the truss has already defined the available length between the two nodes to which the last structure member is to be interposingly connected, the structure member 2 is easily fitted between the nodes 3 and 3.

Figure 3:
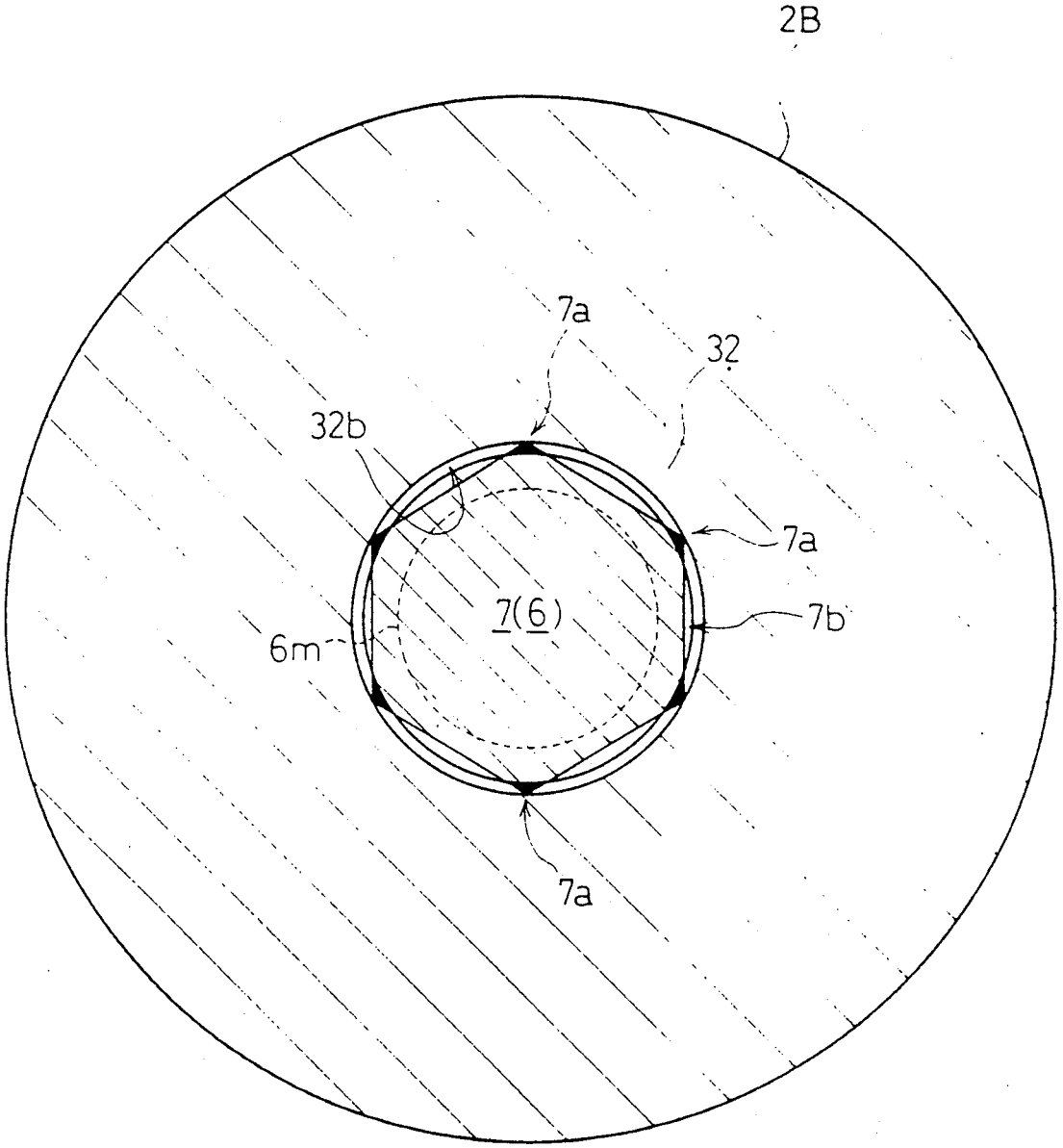
FIG. 3 is a view taken along line III—III of FIG. 6.

Using the torque transmitting surfaces 11A, formed on the outer surface of sleeve 11, the sleeve 11 is positively rotated as indicated by the arrow direction 4 (in FIG. 9). Since the flat part 7*b* is in contact with the square hole 11*a*, the fastening bolt 6 is rotated. As shown in FIG. 6, the threaded part 6*a* of the fastening bolt 6 is not initially engaged with the screw hole 5. As shown in FIG. 3, a rotation of the outside thread 7*a* engaged with the female thread 32*b* of the supporting part 32 causes the fastening bolt 6 to advance.

When the fastening bolt 6 is moved to the side of the node 3, square boss slides within the square hole 11*a*. As shown in FIG. 7, the threaded part 6*a* then commences entry into the screw part 5. Since the pitch "p" of the threaded part 6*a* and the pitch "p" of the outside thread 7*a* are chosen to be identical to each other, the threaded part 6*a* is thus readily engaged with the screw hole 5 of the node 3. When the outside thread 7*a* comes off from the female thread 32*b* as shown by two-dot chain line, the engagement between the threaded part 6*a* and the screw hole 5 reaches a satisfactory state. A rotation of the threaded part 6*a* engaged with the screw hole 5 causes a further advance of the fastening bolt 6 into the node 3 to be made. When the threaded part 6*a* enters deeply into the screw hole 5, as shown in FIG. 1, the bolt head 6*b* makes contact with the end face 32*c* of the supporting part 32. As a result, the fastening bolt 6 cannot make any further advance.

Upon completion of a firm rotation of the sleeve 11, connection between the joint device 30 and the node 3 is achieved. Incorporation of the structure member 2 between two nodes 3 and 3, whose distance apart has ben already defined, is thus facilitated. An initial advance of the fastening bolt 6, made by the rotation of the sleeve 11, can be attained by a means other than the engagement between the threaded part 6*a* and the screw hole 5, i.e., by other means of engaging the female thread 32*b* and the outside thread 7*a* with each other. Even when the structure member 2 is directed to be in a perpendicular state, i.e., used as a vertically oriented member the fastening bolt 6 does not fall back or down due to its weight. Engagement of the fastening bolt 6 into the node 3 is facilitated even under this circumstance of use.

The fastening bolt 6 is covered during its use by the node 3, the sleeve 11, the edge cover 2B, and the main body member 2A. For this reason, fastening bolt 6 is not in direct contact with the atmosphere, hence corrosion of fastening bolt 6 is reduced.

When an improper incorporation of a structure member 2 into a node 3 is made, the sleeve 11 can be easily rotated in a reverse direction. The fastening bolt 6, which is under the state where the threaded part 6*a* and the screw hole 5 are engaged with each other, is thus retracted. Subsequently, before the threaded part 6*a* comes off from the screw hole 5, the outside thread 7*a* commences to be engaged with the female thread 32*b* of the supporting part 32. After the threaded part 6*a* has become disengaged from the screw hole 5, engagement between the outside thread 7*a* and the female thread 32*b* enables the end of the threaded part 6*a* to enter into the sleeve 11. For this reason, it is easy to remove the structure member 2 from the space between two nodes 3 and 3 whose distance apart has already been defined.

Figure 11:
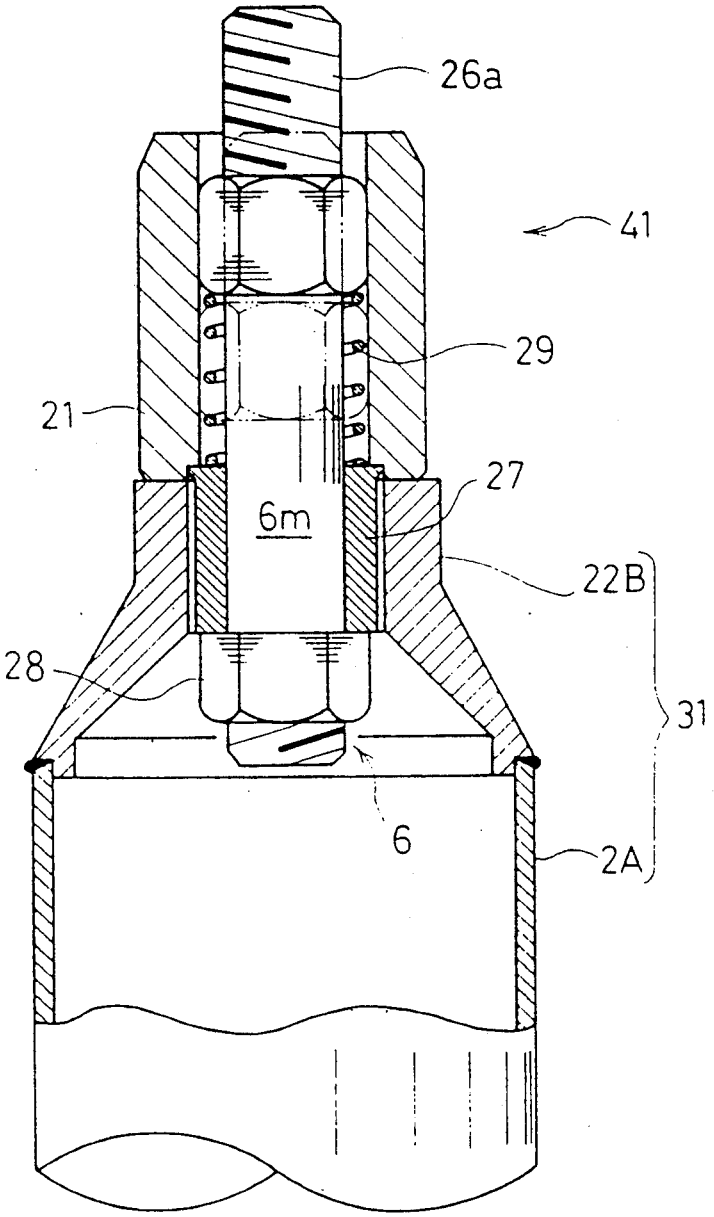
F I G. 11 PRIOR ART
FIG. 11 is a section view of a device according to the prior art, which is equipped with a spring pressing the fastening bolt.

The afore-mentioned connecting operation does no damage to the joint device nor does it let any excessive force act upon the structure member and the fastening bolt. After incorporation of the structure member between the nodes a state where a desired stress takes place as designed is readily attained, thereby enhancing reliability of the structure member. The fastening bolt is completely covered with the sleeve, resulting in restraint of its corrosion. The joint device according to the present invention is not equipped with the spring 29, the supporting member 27, and the anchor bolt 28 all of which are needed in the case of the prior art structure of FIG. 11, hence the number of required elements is reduced. Furthermore, elimination of a space for housing the spring 29 can minimize the overall size of the joint device.

As clearly illustrated in FIG. 10, edge cover 2 in another embodiment may be made somewhat elongated, to have a generally cylindrical portion 22B enlarging in tapered form to the diameter of the main body member 2A to be welded thereto. The rest of the structure and operation for use are the same as for the first embodiment.

INDUSTRIAL APPLICABILITY

The present invention is readily utilized as a joint device for connecting the structure member between nodes in constructing a truss. Even when the distance between the two nodes to which the structure member is to be interposingly connected has been already defined, the structure member can be easily and securely incorporated between the nodes, using the present joint device.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

I claim:

1. A device for connecting a hollow end of an elongate structural member to a connector node having an internally threaded opening ending at a node contact surface, comprising:

a cover shaped and sized to fit and cover said hollow end of the elongate structural member to be welded thereto, said cover having an internally threaded aperture of a predetermined diameter and a length "$l_1$" extending between inner and outer end surfaces;

an elongate bolt having at one end a bolt head that is larger than the diameter of the aperture in the cover and which contacts said inner surface of the cover during use, an unthreaded length "$l_2$" extending from the bolt head and having a diameter smaller than that of the threaded aperture in said cover, a square cross-sectioned boss of a length "$l_3$" having an external thread cut into corner portions thereof such that the square boss can be threaded thereby through the threaded aperture in the cover means, and a distal end having a male thread of the same pitch as the thread formed in the corner portions of the square boss, the male thread being sized to engage with said internally-threaded opening of said node; and a sleeve having a length "$l_4$" longer than "$l_3$", a square through aperture sized to slidingly fit around said square boss, and an outside surface engageable for transmission of a torque to the sleeve, said sleeve having a first end face for contacting the node contact surface and a second end face for contacting the outer end surface of the cover during use, wherein $(l_2+l_3)<(l_4+l_1)$.

2. A device according to claim 1, wherein:

the cover has an elongate form including a substantially cylindrical portion contiguous with a substantially tapered portion sized to fit to said hollow end of the elongate structural member, said length "$l_1$" being defined entirely within the substantially cylindrical portion of the cover.

3. A device according to claim 1, further comprising:

a predetermined length of the elongate structural member, attached to said cover, bolt and sleeve at a first end; and at a second end of said elongate structural member a second cover, a second bolt and a second sleeve of like form.

4. A device according to claim 3, wherein:

the cover has an elongate form including a substantially cylindrical portion contiguous with a substantially tapered portion sized to fit to said hollow end of the elongate structural member, said length "$l_1$" being defined entirely within the substantially cylindrical portion of the cover.

* * * * *